US008529747B2

(12) United States Patent
Gaydos et al.

(10) Patent No.: US 8,529,747 B2
(45) Date of Patent: Sep. 10, 2013

(54) METHODS FOR REPAIRING STEEL COMPONENTS

(75) Inventors: Stephen P. Gaydos, St. Louis, MO (US); Mary Ann Gilman, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 239 days.

(21) Appl. No.: 13/180,973

(22) Filed: Jul. 12, 2011

(65) Prior Publication Data

US 2013/0015074 A1 Jan. 17, 2013

(51) Int. Cl.

| | |
|---|---|
| ***C25D 5/02*** | (2006.01) |
| ***C25D 5/06*** | (2006.01) |
| ***C25D 5/14*** | (2006.01) |
| ***C25D 5/36*** | (2006.01) |
| ***C25D 7/00*** | (2006.01) |

(52) U.S. Cl.

USPC ..... 205/115; 205/117; 205/181; 205/217; 205/223; 205/271

(58) Field of Classification Search

USPC ..... 205/115

See application file for complete search history.

(56) References Cited

U.S. PATENT DOCUMENTS

| | | | | |
|---|---|---|---|---|
| 3,326,782 | A * | 6/1967 | Watson et al. | 205/67 |
| 4,092,347 | A * | 5/1978 | Schenk et al. | 562/113 |
| 4,655,884 | A * | 4/1987 | Hills et al. | 205/181 |
| 4,859,291 | A * | 8/1989 | Takada et al. | 205/272 |
| 4,931,150 | A * | 6/1990 | Smith | 205/118 |
| 6,875,330 | B2 * | 4/2005 | Santini | 205/95 |
| 6,887,366 | B2 * | 5/2005 | Lettmann | 205/115 |
| 7,462,128 | B2 * | 12/2008 | Uchiyama et al. | 476/72 |
| 8,105,473 | B2 * | 1/2012 | Franz | 205/181 |
| 8,273,466 | B1 * | 9/2012 | Saraiya et al. | 428/680 |
| 2005/0034755 | A1 * | 2/2005 | Okada et al. | 136/256 |
| 2009/0252883 | A1 | 10/2009 | Kim et al. | |

FOREIGN PATENT DOCUMENTS

| | | |
|---|---|---|
| DE | 3840310 A1 | 7/1989 |
| EP | 1990446 A1 | 11/2008 |

OTHER PUBLICATIONS

SIFCO Applied Surface Concepts-Comparison of 7280, 5630 and 5644 Nickel electroplating solutions, accessed May 3, 2013.*

Ross et al, An Electrodeposition Technique for Producing Multilayers of Nickel-Phosphorous and Other Alloys, Journal of the Electrochemical Sociiety, vol. 140, No. 1. Jan. 1993, pp. 91-98.*

Crocker, D., and J. Hurrell. "Selective Brush Plating Applications for Shaft Repair." Proceedings of the AESF Annual Technical Conference. vol. 82. American Electroplaters and Surface Finishers Society, 1995.*

Dennis et al, Nickel and Chromium Plating, Chapter 15 High-speed plating, 1993, pp. 423-425 and 430.*

(Continued)

*Primary Examiner* — Harry D Wilkins, III

(74) *Attorney, Agent, or Firm* — Armstrong Teasdale LLP

(57) ABSTRACT

An exposed surface on a steel component is prepared for an application of a nickel high speed solution. The nickel high speed solution is applied to the exposed surface to create an intermediate surface on the component. The intermediate surface is prepared for an application of a nickel sulfamate solution. The nickel sulfamate solution is applied to the intermediate surface to create a duplex brush plating.

20 Claims, 2 Drawing Sheets

(56) References Cited

OTHER PUBLICATIONS

International Search Report and Written Opinion of International Application No. PCT/US2012040934; Aug. 27, 2012; 12 pages.

Olivas, J.D., et al.; An X-Ray photoelectron Spectroscopy Study of Nickel Coating Processes for Aircraft Application; Metal Finishing; Apr. 1995; pp. 46-51; vol. 93, No. 4; Elsevier, New York, NY.

Vanek, D.; An In-Depth Look at Selective Plating Processes: Brush, Anodizing, and Electropolishing; Metal Finishing; Sep. 2012; pp. 25-32; vol. 108, No. 9; Elsevier, New York, NY.

Gilman, Mary; Repair of Damaged Hard Chrome Plating of HBOF Thermal Spray Coating; Surfin Conf.; dated Jun. 14-17, 2010; pp. 20.

Electroplating; Wikipedia; http://en.wikipedia.org/wiki/Electroplating; dated Jul. 12, 2011; pp. 8.

* cited by examiner

METHODS FOR REPAIRING STEEL COMPONENTS

STATEMENT REGARDING FEDERALLY SPONSORED RESEARCH AND DEVELOPMENT

This invention was made with United States Government support under Contract Number FA8614-08-D-2080 awarded by the Department of Defense. The United States Government has certain rights in this invention.

BACKGROUND

The present disclosure relates generally to steel components and, more particularly, to methods for use in repairing steel aircraft components using duplex nickel brush plating.

At least some components used on an aircraft, such as a landing gear, are fabricated at least partially from steel and/or high strength steel. A coating, such as chrome plating, nickel plating, and/or high velocity oxy-fuel (HVOF) thermal spray coating, is then applied to the components to facilitate increasing a wear-resistance and/or a corrosion-resistance of the component. Known coatings, however, are susceptible to damage during service and/or use of the aircraft. To repair damage to coatings, generally the associated component must be removed from the aircraft prior to stripping the old coating. A new coating is reapplied to the component, and the component is reinstalled on the aircraft. As such, repairing such damage to known coatings may be costly, labor intensive, and/or time consuming

BRIEF DESCRIPTION

In one aspect, a method is provided for in situ repair of plating on a component. The method includes preparing an exposed surface on the plating for an application of a nickel high speed solution. The nickel high speed solution is applied to the exposed surface to create an intermediate surface on the component. The intermediate surface is prepared for an application of a nickel sulfamate solution. The nickel sulfamate solution is applied to the intermediate surface to create a duplex brush plating.

In another aspect, a method is provided for in situ repair of plating on a component. The method includes extending a first nickel strike layer on top of an exposed surface on the component. A nickel high speed layer is extended on top of the first nickel strike layer. A second nickel strike layer is extended on top of the nickel high speed layer. A nickel sulfamate layer is extended on top of the second nickel strike layer.

In yet another aspect, a method is provided for in situ repair of plating on a component. The method includes masking at least a portion of the component such that at least an exposed surface is accessible for repair. A nickel high speed layer is extended on top of the exposed surface. A nickel sulfamate layer is extended on top of the nickel high speed layer.

The features, functions, and advantages described herein may be achieved independently in various embodiments of the present disclosure or may be combined in yet other embodiments, further details of which may be seen with reference to the following description and drawings.

Although specific features of various embodiments may be shown in some drawings and not in others, this is for convenience only. Any feature of a drawing may be referenced and/or claimed in combination with any feature of any other drawing.

DETAILED DESCRIPTION

The subject matter described herein relates generally to steel components and, more particularly, to methods for use in repairing high strength steel aircraft components using duplex nickel brush plating. In one embodiment, a repair method includes brush electroplating a high strength steel component to quickly, easily, and/or safely repair damaged chrome plating, nickel plating, and/or high velocity oxy-fuel (HVOF) thermal spray coating that was previously applied to the high strength steel component. During repair, the steel component is initially prepared for an application of a nickel high speed solution, and the nickel high speed solution is then applied to the steel component to facilitate decreasing a hydrogen embrittlement and/or fatigue of the steel component. A nickel sulfamate solution is then applied to the steel component to facilitate increasing a corrosion resistance and/or a wear resistance of the steel component. As such, the brush plating process described herein enables a duplex nickel coating to be applied to a desired area in situ without removing the component from the aircraft.

As used herein, an element or step recited in the singular and proceeded with the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

Figure 1:
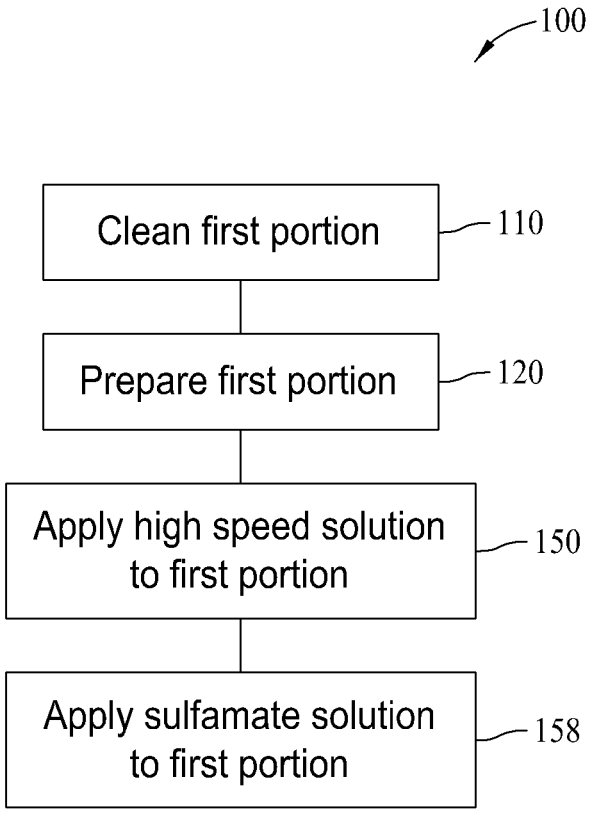
FIG. 1 is a flow chart illustrating an exemplary method that may be used to repair damaged plating on a component.
Figure 2:
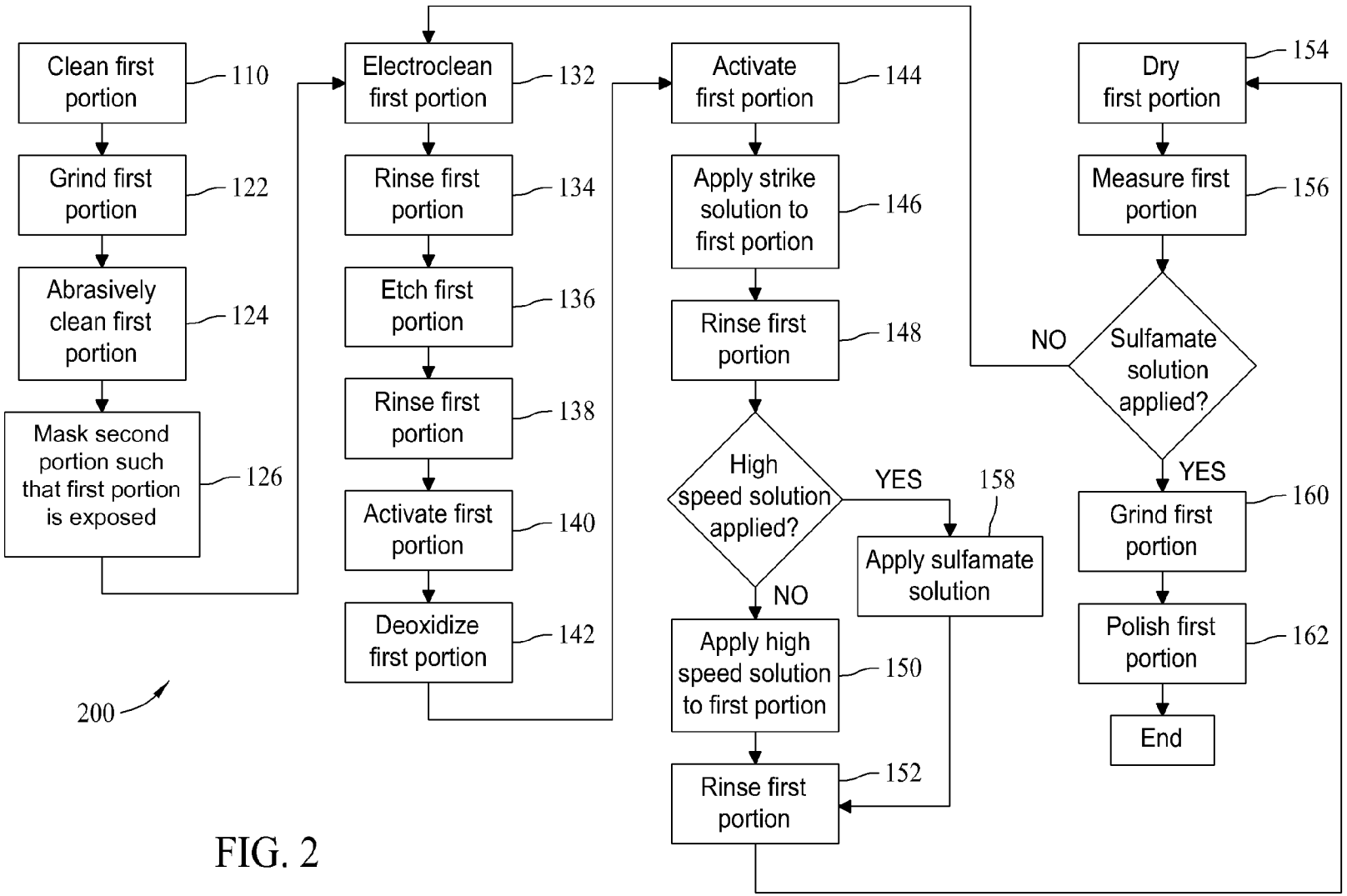
FIG. 2 is a detailed flow chart illustrating the exemplary method shown in FIG. 1.

FIGS. 1 and 2 illustrate an exemplary method 100 that may be used to repair a damaged coating or plating (not shown) that was previously applied to a component (not shown). In the exemplary embodiment, the plating to be repaired includes a layer of material that is applied to a surface to impart a desired property to the surface. For example, the plating may be applied to the surface to facilitate increasing an abrasion resistance, a wear resistance, a corrosion resistance, a lubricity, and/or an aesthetic quality of the surface.

To repair damaged plating, in the exemplary embodiment, a first portion (not shown) of the component is initially cleaned 110 in situ. More specifically, in the exemplary embodiment, the component is cleaned 110 to facilitate removing molecular layers of oil and/or dirt that may prevent adhesion of the repair plating to the first portion. Moreover, in the exemplary embodiment, cleaning 110 may include solvent cleaning, aqueous cleaning, hot alkaline detergent cleaning, electrocleaning, and/or acid cleaning. Alternatively, cleaning 110 may be performed using any process that enables damaged plating to be repaired as described herein. In one embodiment, a waterbreak test may be used to verify that the first portion is suitably clean.

In the exemplary embodiment, the first portion is then prepared 120 to enable an application of a nickel coating (not shown) to be applied. For example, in the exemplary embodiment, the nickel coating is a duplex nickel coating that includes a nickel high speed layer and a nickel sulfamate layer. Alternatively, the nickel coating may include any composition that enables the coating to function as described herein.

To prepare the first portion for the nickel coating application, at least some of the damaged plating is removed to create an exposed surface on the component. More specifically, in the exemplary embodiment, the first portion is sanded or ground 122 in situ to remove and/or to facilitate reducing sharp edges projecting from the first portion. In the exemplary embodiment, a grinding tool (not shown) including a plurality of grinding bits may be used to sand and/or grind 122 the first portion.

Moreover, in the exemplary embodiment, the first portion is then abrasively cleaned 124 to further remove and/or reduce any additional sharp edges projecting from the first portion. For example, in the exemplary embodiment, a grit blaster and/or sand paper (not shown) is used to abrasively clean 124 the first portion. Alternatively, grinding 122 and/or cleaning 124 may be performed using any device and/or tool that enables damaged plating to be repaired as described herein.

Once the first portion is suitably cleaned and is substantially smooth, a second portion (not shown) of the component is screened or masked 126 such that the second portion is substantially shielded and is suitably protected while the first portion remains accessible and exposed for repair. In the exemplary embodiment, vinyl tape, polytetrafluoroethylene (PTFE) tape, and/or a liquid maskant is applied across the second portion during masking 126 to facilitate decreasing undesired exposure of the second portion to the repair process. Alternatively, masking 126 may be performed using any mechanism that enables damaged plating to be repaired as described herein.

To prepare the first portion for an application of a nickel high speed solution, in the exemplary embodiment, the first portion is electrocleaned 132 using an electroclean solution at between approximately 1 and 20 volts (V), reverse current for between approximately one and thirty seconds. More particularly, the first portion is electrocleaned 132 at approximately 10 V, reverse current for between approximately 10 and 15 seconds. In the exemplary embodiment, the electroclean solution may be LDC-01 Electroclean manufactured by Liquid Development Company, headquartered in Cleveland, Ohio and/or SIFCO 1010 Electroclean manufactured by SIFCO Applied Surface Concepts, headquartered in Independence, Ohio. Alternatively, the electroclean solution may be any suitable solution that enables damaged plating to be repaired as described herein. Moreover, the first portion may be electrocleaned 132 at any suitable voltage for any amount of time that enables damaged plating to be repaired as described herein.

After electrocleaning 132 the first portion, in the exemplary embodiment, the first portion is rinsed 134. In the exemplary embodiment, the first portion is then etched 136 using an etch solution at between approximately 1 and 20 V, reverse current for between approximately one and thirty seconds. More particularly, the first portion is etched 136 at approximately 10 V, reverse current for between approximately ten and fifteen seconds. In the exemplary embodiment, the etch solution may be LDC-04 Activator & Etch manufactured by Liquid Development Company, headquartered in Cleveland, Ohio and/or SIFCO 1024 Etch manufactured by SIFCO Applied Surface Concepts, headquartered in Independence, Ohio. Alternatively, the etch solution may be any suitable solution that enables damaged plating to be repaired as described herein. Moreover, the first portion may be etched 136 at any suitable voltage for any amount of time that enables damaged plating to be repaired as described herein.

After etching 136 the first portion, in the exemplary embodiment, the first portion is then rinsed 138. In the exemplary embodiment, the first portion is then activated 140 using a suitable activator solution at between approximately 1 and 20 V, forward current for between approximately one and thirty seconds. More particularly, the first portion is activated 140 at approximately 10 V, forward current for between approximately ten and fifteen seconds. Alternatively, the first portion may be activated 140 at any suitable voltage for any amount of time that enables damaged plating to be repaired as described herein. In the exemplary embodiment, the activator solution may be LDC-04 Activator & Etch manufactured by Liquid Development Company, headquartered in Cleveland, Ohio and/or SIFCO 1021 Activator manufactured by SIFCO Applied Surface Concepts, headquartered in Independence, Ohio. Alternatively, the activator solution may be any suitable solution that enables damaged plating to be repaired as described herein.

Moreover, in the exemplary embodiment, the first portion is deoxidized 142 using abrasive pads that are wet with a suitable etch solution, and the first portion is activated 144 using a suitable etch solution at between approximately 1 and 20 V, forward current for between approximately one and thirty seconds. More particularly, the first portion is activated 144 at approximately 10 V, forward current for between approximately five and ten seconds. Alternatively, the first portion may be activated 144 at any suitable voltage for any amount of time that enables damaged plating to be repaired as described herein.

In the exemplary embodiment, a nickel strike solution is applied 146 to the first portion at between approximately 10 and 12 V, forward current. In the exemplary embodiment, the nickel strike provides a relatively thin foundation (not shown) that enables a subsequent plating to adhere to the first portion. In the exemplary embodiment, the foundation is between approximately 0.05 and 0.1 mils thick. Alternatively, the foundation may have any suitable thickness that enables damaged plating to be repaired as described herein. In the exemplary embodiment, the nickel strike solution may be LDC-2807 Nickel Acid manufactured by Liquid Development Company, headquartered in Cleveland, Ohio and/or SIFCO 5630 Nickel Special manufactured by SIFCO Applied Surface Concepts, headquartered in Independence, Ohio. Alternatively, the nickel strike solution may be any suitable solution that enables damaged plating to be repaired as described herein. Moreover, the nickel strike solution may be applied 146 at any suitable voltage for any amount of time that enables damaged plating to be repaired as described herein.

After applying 146 the nickel strike solution, in the exemplary embodiment, the first portion is rinsed 148. In the exemplary embodiment, a nickel high speed solution is then applied 150 to the first portion by brush plating at between approximately 6 and 9 V, forward current. In the exemplary embodiment, the nickel high speed is applied 150 such that a first or intermediate layer that is between approximately 1 and 2 mils thick is formed. Alternatively, the first layer may have any suitable thickness that enables damaged plating to be repaired as described herein. In the exemplary embodiment, the nickel high speed solution may be LDC-2803 Nickel Hi-Speed manufactured by Liquid Development Company, headquartered in Cleveland, Ohio and/or SIFCO 5644 Nickel (High Speed) manufactured by SIFCO Applied Surface Concepts, headquartered in Independence, Ohio. Alternatively, the nickel high speed solution may be any suitable solution that enables damaged plating to be repaired as described herein. Moreover, the nickel high speed solution may be applied 150 at any suitable voltage for any amount of time that enables damaged plating to be repaired as described herein.

In the exemplary embodiment, the first portion is rinsed 152, dried 154, and measured 156 to verify that the first layer is between approximately 1 and 2 mils thick. To apply a second layer of nickel sulfamate, in the exemplary embodiment, the first portion is electrocleaned 132, rinsed 134, etched 136, rinsed 138, activated 140, deoxidized 142, and/or activated 144 to suitably prepare the first portion for the application 146 of the nickel strike solution.

After applying 146 the nickel strike solution, in the exemplary embodiment, the first portion is rinsed 148, and a nickel sulfamate solution is then applied 158 to the first portion by brush plating at between approximately 6 and 12 V, forward current. In the exemplary embodiment, the nickel sulfamate is applied 158 such that a second layer that is between approximately 2 and 4 mils thick is formed. Alternatively, the second layer may have any suitable thickness that enables damaged plating to be repaired as described herein. In the exemplary embodiment, the nickel sulfamate solution may be LDC-2820 Nickel Sulfamate (Soft), LDC-2840 Nickel Sulfamate (Medium), and/or LDC-2854 Nickel Sulfamate (Hard) manufactured by Liquid Development Company, headquartered in Cleveland, Ohio and/or SIFCO 7280 Nickel Sulfamate (Soft), SIFCO 7281 Nickel Sulfamate (Medium), and/or SIFCO 7282 Nickel Sulfamate (Hard) manufactured by SIFCO Applied Surface Concepts, headquartered in Independence, Ohio. Alternatively, the nickel sulfamate solution may be any suitable solution that enables damaged plating to be repaired as described herein. Moreover, the nickel sulfamate solution may be applied 158 at any suitable voltage for any amount of time that enables damaged plating to be repaired as described herein.

In the exemplary embodiment, the first portion is rinsed 152, dried 154, and measured 156 to verify that the second layer is between approximately 2 and 4 mils thick. In the exemplary embodiment, a height of the first layer and/or the second layer is substantially similar to the plating on the second portion of the component. In the exemplary embodiment, the first portion is ground 160 and polished 162 to facilitate blending the first portion with the second portion.

The subject matter described herein enables in situ repair of steel and/or high strength steel components by creating a duplex nickel brush plating that is non-embrittling, does not reduce fatigue life, is corrosion resistant, and/or improves a wear resistance of a steel component. The exemplary embodiments enable a chrome plating, a nickel plating, and/or a thermal spray coating on a steel component to be quickly, easily, and/or safely repaired without removing the steel component from an aircraft. Moreover, the exemplary embodiments enable a desired portion of the steel component to be repaired such that stripping and/or reapplying the plating and/or coating on the entire steel component is not required. Accordingly, the subject matter described herein facilitates reducing down time and/or costs associated with repairing damaged steel components. Moreover, the subject matter described herein facilitates reducing the use and/or exposure of hazardous chemicals used to strip and/or reapply plating.

Exemplary embodiments of methods for repairing damaged steel components are described above in detail. The systems and methods are not limited to the specific embodiments described herein, but rather, components of systems and/or steps of the method may be utilized independently and separately from other components and/or steps described herein. Each component and each method step may also be used in combination with other components and/or method steps. Although specific features of various embodiments may be shown in some drawings and not in others, this is for convenience only. Any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of in situ repair of plating applied over a component, said method comprising:

preparing an exposed surface on the plating for an application of a nickel high speed solution;

applying the nickel high speed solution to the exposed surface to create an intermediate surface on the component;

preparing the intermediate surface for an application of a nickel sulfamate solution; and applying the nickel sulfamate solution to the intermediate surface to create a duplex brush plating.

2. A method in accordance with claim 1, wherein preparing an exposed surface further comprises removing at least a portion of the plating to create the exposed surface on the component.

3. A method in accordance with claim 1, wherein preparing an exposed surface further comprises cleaning the plating using at least one of a solvent and an aqueous cleaner.

4. A method in accordance with claim 1, wherein preparing an exposed surface further comprises grinding the plating using a grinding tool that includes a plurality of grinding bits.

5. A method in accordance with claim 1, wherein preparing an exposed surface further comprises abrasively cleaning the plating using at least one of a grit blaster and a sand paper.

6. A method in accordance with claim 1, wherein preparing an exposed surface further comprises masking at least a portion of the component such that at least the exposed surface is accessible for repair.

7. A method in accordance with claim 1, wherein preparing the exposed surface further comprises:

electrocleaning the exposed surface using an electroclean solution; and rinsing the exposed surface.

8. A method in accordance with claim 1, wherein preparing the exposed surface further comprises:

etching the exposed surface using a first etch solution;

rinsing the exposed surface; and activating the first etch solution.

9. A method in accordance with claim 1, wherein preparing the exposed surface further comprises:

deoxidizing the exposed surface using an abrasive pad including a second etch solution; and activating the deoxidized surface using an activator solution.

10. A method in accordance with claim 1, wherein preparing the exposed surface further comprises applying a nickel strike solution to the exposed surface.

11. A method in accordance with claim 1, wherein preparing the intermediate surface further comprises:

electrocleaning the intermediate surface using an electroclean solution; and rinsing the intermediate surface.

12. A method in accordance with claim 1, wherein preparing the exposed surface further comprises:

etching the intermediate surface using a first etch solution;

rinsing the intermediate surface; and activating the first etch solution.

13. A method in accordance with claim 1, wherein preparing the exposed surface further comprises:

deoxidizing the intermediate surface using an abrasive pad including a second etch solution; and activating the deoxidized surface using an activator solution.

14. A method in accordance with claim 1, wherein preparing the exposed surface further comprises applying a nickel strike solution to the intermediate surface.

15. A method in accordance with claim 1 further comprising grinding the duplex brush plating.

16. A method in accordance with claim 1 further comprising polishing the duplex brush plating.

17. A method of in situ repair of plating applied over a component, said method comprising:

extending a first nickel strike layer on top of an exposed surface on the component;

extending a nickel high speed layer on top of the first nickel strike layer;

extending a second nickel strike layer on top of the nickel high speed layer; and extending a nickel sulfamate layer on top of the second nickel strike layer.

18. A method in accordance with claim 17 further comprising:

electrocleaning a portion of the component prior to extending at least one of the first nickel strike layer and extending the second nickel strike layer;

etching the electrocleaned portion of the component; and deoxidizing the etched portion of the component.

19. A method of in situ repair of plating on a component, said method comprising:

masking at least a portion of the component such that at least an exposed surface is accessible for repair;

extending a nickel high speed layer on top of the exposed surface; and extending a nickel sulfamate layer on top of the nickel high speed layer.

20. A method in accordance with claim 19 further comprising extending a nickel strike layer on top of at least one of the exposed surface and the nickel high speed layer.

* * * * *